US008368725B1

(12) United States Patent
Yang

(10) Patent No.: US 8,368,725 B1
(45) Date of Patent: Feb. 5, 2013

(54) LASER SCROLLING COLOR SCHEME FOR PROJECTION DISPLAY

(75) Inventor: Long Yang, Union City, CA (US)

(73) Assignee: Rossella Limited, Tortola (VG)

( * ) Notice: Subject to any disclaimer, the term of this patent is extended or adjusted under 35 U.S.C. 154(b) by 706 days.

(21) Appl. No.: 12/216,242

(22) Filed: Jul. 1, 2008

Related U.S. Application Data

(60) Provisional application No. 60/929,542, filed on Jul. 2, 2007.

(51) Int. Cl.
*G09G 5/10* (2006.01)

(52) U.S. Cl. ..... 345/690; 345/87; 345/89; 345/204; 349/5; 349/8; 362/227

(58) Field of Classification Search ..... 345/32, 345/690, 87, 89, 90, 204, 214; 353/31, 32; 348/744, 758, 766; 349/5–8; 362/227, 234, 362/235

See application file for complete search history.

(56) References Cited

U.S. PATENT DOCUMENTS

| | | | | |
|---|---|---|---|---|
| 6,760,134 | B1 * | 7/2004 | Schilling et al. | 359/10 |
| 6,945,652 | B2 * | 9/2005 | Sakata et al. | 353/30 |
| 7,728,912 | B2 * | 6/2010 | Anderson et al. | 348/744 |
| 2001/0024326 | A1 * | 9/2001 | Nakamura et al. | 359/618 |
| 2003/0160859 | A1 * | 8/2003 | Roddy et al. | 347/239 |
| 2004/0141220 | A1 * | 7/2004 | Hama et al. | 359/204 |
| 2005/0024699 | A1 * | 2/2005 | Liu | 359/196 |
| 2005/0280785 | A1 * | 12/2005 | Beeson et al. | 353/97 |
| 2006/0126022 | A1 * | 6/2006 | Govorkov et al. | 353/31 |
| 2007/0076092 | A1 * | 4/2007 | Yeo et al. | 348/108 |
| 2007/0147215 | A1 * | 6/2007 | Sakaguchi et al. | 369/103 |
| 2007/0188417 | A1 * | 8/2007 | Hajjar et al. | 345/75.1 |
| 2007/0200866 | A1 * | 8/2007 | Lee et al. | 345/589 |
| 2007/0273889 | A1 * | 11/2007 | An et al. | 356/460 |
| 2009/0002265 | A1 * | 1/2009 | Kitaoka et al. | 345/4 |
| 2010/0020291 | A1 * | 1/2010 | Kasazumi et al. | 353/38 |

* cited by examiner

*Primary Examiner* — Lun-Yi Lao
*Assistant Examiner* — Priyank Shah
(74) *Attorney, Agent, or Firm* — Ladas & Parry, LLP

(57) ABSTRACT

Methods and systems for improved optical efficiency and brightness of display systems are provided herein. Embodiments use laser light sources in substantially continuous mode, thereby increasing the maximum overall output of an optical system. Embodiments exploit the small étendue of laser sources to lower the loss of throughput of an optical system. Embodiments enable a scrolling color scheme that allows a display system to be illuminated with two or more colors at any given time, thereby increasing the brightness of the display system. Embodiments can be used with liquid crystal displays and/or digital mirror displays. Embodiments can be used in single-panel and/or two-panel display systems.

25 Claims, 5 Drawing Sheets

LASER SCROLLING COLOR SCHEME FOR PROJECTION DISPLAY

CROSS-REFERENCE TO RELATED APPLICATIONS

The present application claims the benefit of U.S. Provisional Patent Application No. 60/929,542, filed Jul. 2, 2007, which is incorporated herein by reference in its entirety.

FIELD OF THE INVENTION

The present invention relates generally to display systems. More particularly, the invention relates to methods and systems for optimizing the optical efficiency and brightness of projection display systems.

BACKGROUND OF THE INVENTION

The brightness of a projection display system is related to the minimum of the system étendue and the étendue of the light source used in the system. Therefore, when a mismatch between the system étendue and the source étendue occurs, the optical efficiency of the system is suboptimal.

Generally, the cost and size of optical components impose limitations on the increase of the system étendue of a particular projection display system. On the other hand, the source étendue is related to the surface area and emission pattern of the light source.

However, once the source étendue exceeds the system étendue, negligible benefits in terms of brightness can be achieved by increasing the surface area of the light source. To further increase the brightness of the system, the optical flux of the light source would need to be increased (for example, increasing the temperature of an incandescent light bulb), which results in a more expensive display system.

Therefore, methods and systems that enable improved brightness in projection display systems without suffering from the above described limitations are needed.

BRIEF SUMMARY OF THE INVENTION

The present invention relates generally to display systems. More particularly, the invention relates to methods and systems for optimizing the optical efficiency and brightness of projection display systems.

Embodiments of the present invention provide methods and systems for improved optical efficiency and brightness of display systems.

Embodiments of the present invention use laser light sources with high duty cycle, thereby increasing the maximum overall output of an optical system.

Embodiments of the present invention exploit the small étendue of laser sources to lower the loss of throughput of an optical system.

Embodiments of the present invention enable a scrolling color scheme that allows a display system to be illuminated with two or more colors at any given time, thereby increasing the brightness of the display system.

Embodiments of the present invention can be used with liquid crystal displays and/or digital mirror displays.

Embodiments of the present invention can be used in single-panel and/or two-panel display systems.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. Generally, the drawing in which an element first appears is typically indicated by the leftmost digit(s) in the corresponding reference number.

DETAILED DESCRIPTION OF EMBODIMENTS OF THE INVENTION

Color-Scrolling Projection Display

Figure 1:
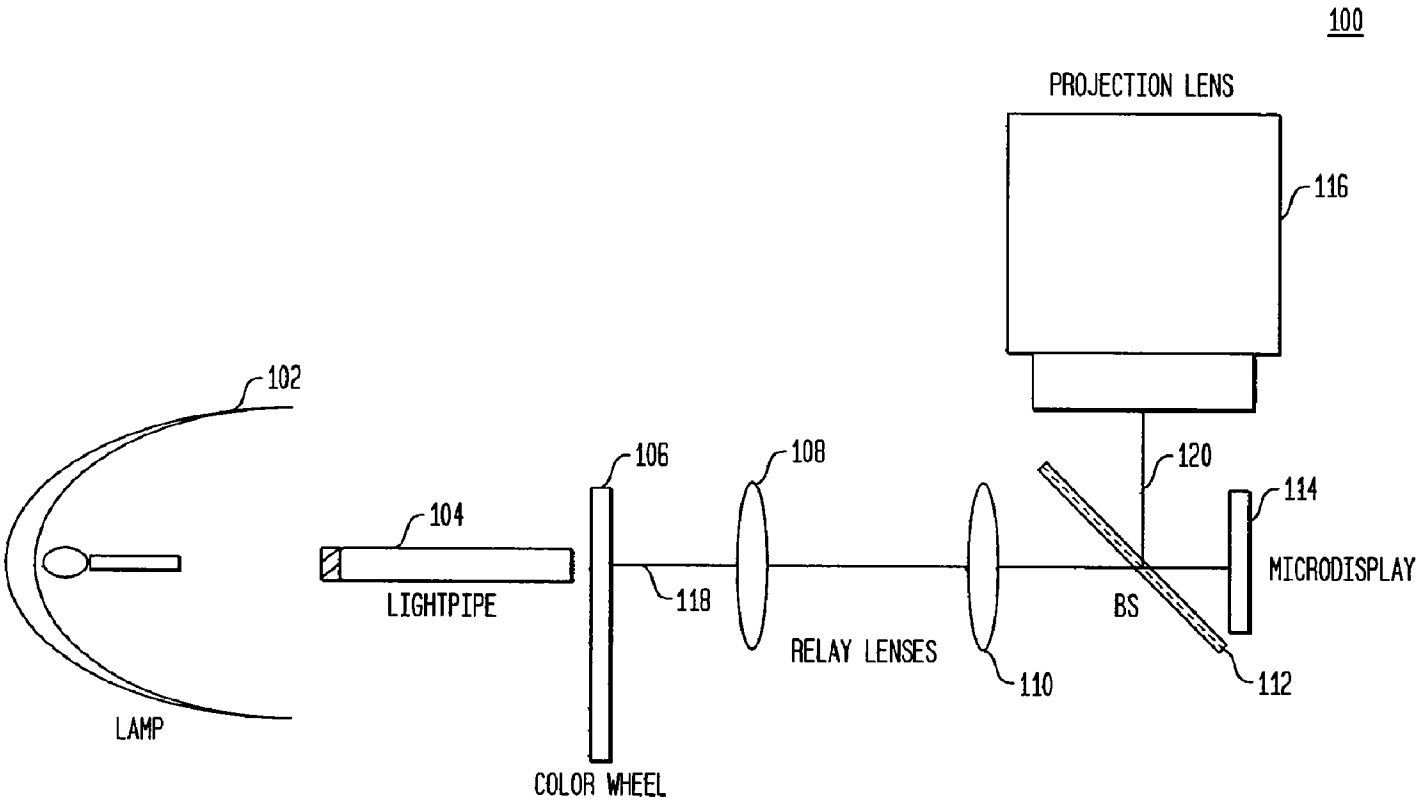
FIG. 1 illustrates an example color-scrolling projection display system.

FIG. 1 illustrates an example projection display system 100. Example system 100 includes a lamp 102, a lightpipe 104, a color wheel 106, relay lenses 108 and 110, a beam splitter (BS) 112, a display panel 114, and a projection lens 116.

Lamp 102 emits a polychromatic light. Lamp 102 may be a high pressure lamp or light emitting diode, for example. Light from lamp 102 passes through a lightpipe 104 for purposes of homogenization of the illumination and polarization conversion. Polarization conversion for liquid-crystal-based displays is typically needed because the light emitted by lamp 102 is generally unpolarized. Polarization conversion can be done in a variety of ways, in addition to using a lightpipe as illustrated in FIG. 1

At the output of lightpipe 104, light is polarized. For example, light may be p-polarized after exiting lightpipe 104 (i.e., the electric field of the light oscillates in the plane of the diagram).

At the exit surface of lightpipe 104, a color wheel 106 is positioned such as to receive the light from lightpipe 104 and generate a filtered light 118. Color wheel 106 is typically divided into one or more color filter segments, with the filter segments being of equal or different sizes depending on the optical system. Color wheel 106 rotates at a speed so as to sequentially place different color filters in the path of the polychromatic light. As such, color wheel 106 sequentially passes different color components of the polychromatic light in filtered light 118. The rotation speed of color wheel 106 is related to a frame refresh rate of display system 100.

Filtered light 118 is passed through one or more relay lenses, as illustrated by relay lenses 108 and 110, to focus the light in the direction of display panel 114. In an embodiment, display panel 114 is a Liquid Crystal (LC) display panel. In another embodiment, display panel 114 is a digital mirror panel such as a Digital Light Processing (DLP) panel.

Being p-polarized, filtered light 118 passes, with minimal reflection, through beam splitter (BS) 112 to reach display panel 114. Display panel 114 modulates light 118 according to voltage values applied to pixels of the panel. Typically, a pixel of display panel 114 reflects, deflects, or blocks light 118 according to a voltage applied thereto, thereby modulating the brightness of the light. For example, in the case of an LC panel, display panel converts a portion of p-polarized light 118 into s-polarized light (i.e., the electric field of the light oscillates in a plane perpendicular to the plane of the diagram), depending on a voltage applied thereto. Display panel 114 then reflects the s-polarized light in the direction of BS 112, which reflects s-polarized light 120 in the direction of projection lens 116. The remaining p-polarized portion of light 118 passes through BS 112 with minimal reflection. Accordingly, the brightness of projection display system 100 is controlled through display panel 114. Similarly, for a digital mirror panel, the amount of light that is reflected at projection lens system 116 by panel 114 is modulated according to the voltage sequence applied to each pixel of panel 114.

Projection lens 116 receives light 120 and projects a corresponding color image.

As described above, projection display system 100 uses a color scrolling scheme. One advantage of using color scrolling can be achieved by controlling the update rate of display panel 114 as a function of the rotation speed of color wheel 106, or vice versa, to increase the spectrum efficiency of the projection display system. For example, the update rate of display panel 114 can be controlled such that display panel 114 is illuminated with more than one color at any given time, with illumination optics of system 100 focusing each color onto a different portion of display panel 114. Alternatively, the rotation speed of color wheel 106 or the sizes of the color filters within color wheel 106 can be controlled to achieve similar effect.

By increasing the spectrum efficiency of the projection display system, color scrolling improves the brightness of the projection display system. However, the brightness of the projection display system is also related to the light source étendue and the system étendue, with either the light source étendue or the system étendue operating as a bottleneck to the brightness of the system. For example, negligible benefits in terms of brightness can be gained if the system étendue is made greater than the light source étendue. At the same time, the system étendue would limit the brightness of the display system when lower than the light source étendue. As such, the efficiency of the display system is optimized when the light source étendue matches the system étendue.

In the case of an incoherent light source such as lamp 102 (which emits light in a random fashion so as to generate a uniform emitting pattern in all directions), the light source étendue depends on the surface area of the light source. On the other hand, the system étendue is typically related to the display panel area (which is directly related to the surface area of the display panel) and the acceptance solid angle of the projection lens.

Accordingly, color scrolling results in a mixed effect on the brightness of projection display system 100. While color scrolling improves brightness by allowing more than one color to illuminate display panel 114 at any given time, it lowers the system étendue when light is focused on only a portion of the display panel 114. For example, if the display panel étendue is equal to the light source étendue, by focusing the light source onto ⅓ of display panel 114, approximately ⅔ of the light would be lost. This would reverse the gains in brightness due to color scrolling, unless the display panel étendue can be made much greater than the light source étendue.

Generally, the cost and size of optical components restrict the increase of the system étendue by varying these two design parameters. Accordingly, when incoherent light sources are used, once the source étendue exceeds the system étendue, negligible benefits in terms of brightness can be achieved by increasing the surface area of the light source.

Due to this physical constraint, the only way to increase the brightness of the display system would then be by increasing the brightness of the light source, which can be done by increasing the optical flux of the light source without increasing its surface area.

Laser-Source Projection Display

Laser light sources remove the above described limitation because laser light is highly coherent and characterized by directional light emission.

Figure 2:
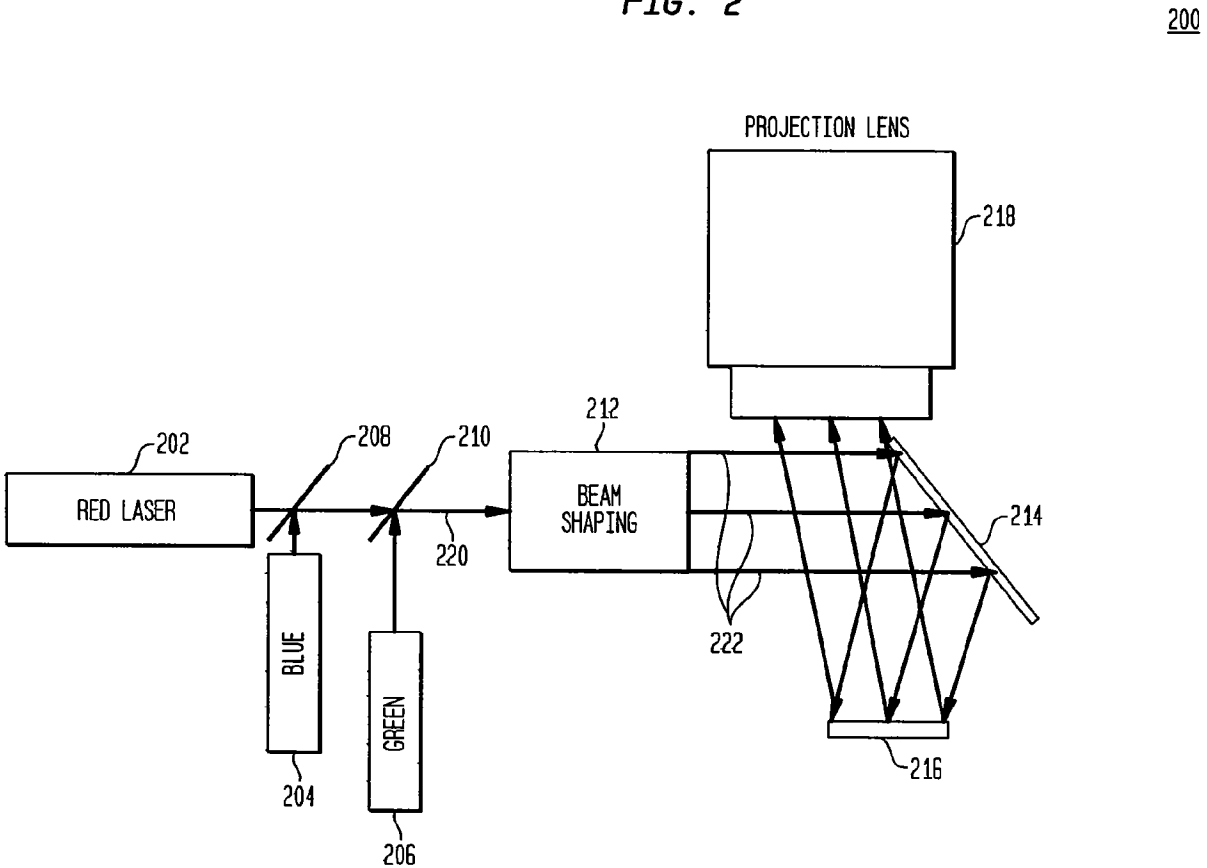
FIG. 2 illustrates an example laser-source projection display system.

FIG. 2 illustrates an example laser-source projection display system 200. Example system 200 includes red, blue, and green laser sources 202, 204, and 206, colors filters 208 and 210, a mirror 214, a beam shaping apparatus 212, a display panel 216, and a projection lens 218.

Example system 200 operates in a sequential mode so that only one of laser sources 202, 204, and 206 is used at any given time. Accordingly, when a given color laser is being used, the other laser sources are turned off to avoid color distortion.

As illustrated in FIG. 2, color filters 208 and 210 respectively reflect light emitted by laser sources 204 and 206 but allow light emitted by laser source 202 to pass through them without reflection. As such, emitted light 220 includes the light emitted by one of laser sources 202, 204, and 206 at any given time.

Beam shaping apparatus 212 receives emitted light 220 and generates a plurality of laser beams 222 from emitted light 220.

Mirror 214 reflects laser beams 222 in the direction of display panel 216. In display panel 216, pixels are controlled depending on the laser color in emitted beams 222, by applying appropriate modulation voltages to the pixels. Alternatively, a beam splitter, as illustrated by beam splitter 112 in FIG. 1, can be used instead of mirror 214 to effectuate the reflection of laser beams 222 onto display panel 214 and then of the modulated beams onto projection lens 218.

As example system 200 operates in a sequential mode, laser sources 202, 204, and 206 have to be operated in pulse mode. Pulse mode operation results in a reduction in the average output power of laser sources 202, 204, and 206. While this reduction may be compensated by the application of higher pulse power at the lasers, physical limitations impose an upper bound on applied pulse power. For example, in semiconductor lasers, electrical current is used to provide electrons and holes to the laser gain medium. However, when the current is too high, a significant proportion of carriers escape from the laser gain medium before the light emitting processes can occur, effectively contributing to a reduction in average output power.

Because of reduction in useable average output power, the overall brightness of example projection display system 200 may be suboptimal. This can be remedied, for example, by using higher power lasers or more than one display panel, though resulting in a more expensive display system.

Laser-Scrolling Projection Display

Figure 3:
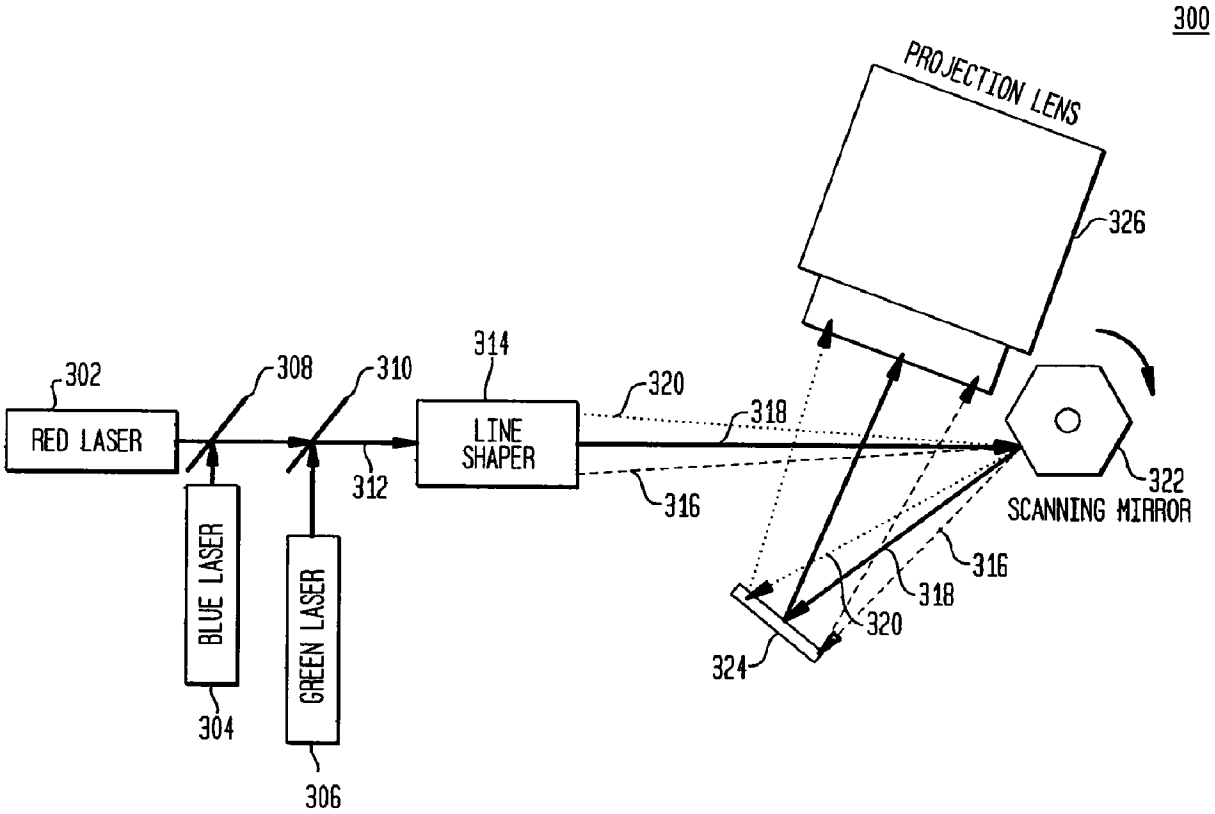
FIG. 3 illustrates an example laser-scrolling projection display system.

FIG. 3 illustrates an example laser-scrolling projection display system 300. Example system 300 includes red, blue, and green laser sources 302, 304, and 306, colors filters 308 and 310, a line shaper 314, a scanning mirror 322, a display panel 324, and a projection lens 326.

Laser sources 302, 304, and 306 operate in continuous mode so that all three sources are operating at any given time. As referred to herein, continuous mode refers to driving the laser source continuously or substantially continuously with an electrical signal, resulting in highest laser efficiency. For example, a laser source may be driven using an 80 KHz square wave to achieve the peak intensity required for efficient second harmonics generation. As illustrated in FIG. 3, color filters 308 and 310 respectively reflect light emitted by laser sources 304 and 306 but allow light emitted by laser source 302 to pass through them without reflection. As such, light 312 is a combination of lights emitted by laser sources 302, 304, and 306.

Embodiments of the present invention are not limited to the three-color system described above. In an embodiment, additional laser sources emitting, for example, yellow and cyan laser may also be used. Further, the system is not limited to three laser sources. For example, each laser source may comprise a laser package, which includes an array of small lasers. Also, for thermal reasons, more than one laser package may be used to boost power.

Line shaper 314 receives light 312 and shapes it to regenerate individual red, green, and blue laser components 316, 318, and 320 with aspect ratios (line or stripe) much larger than that of the display itself. It is noted that although FIG. 3 illustrates the combining of lights emitted by laser sources 302, 304, and 306 prior to entering line shaper 314, in certain situations, it is equally preferable to perform the beam combining at a different location; for example, after the scanning mechanism.

Scanning mirror 322 is a spinning polygon mirror. In other embodiments, scanning mirror 322 can be replaced by a rotating prism or any other beam scanning device. Scanning mirror 322 spins at a speed such that its reflection of laser components 316, 318, and 320 results in a scrolling of laser components 316, 318, and 320 across the surface of display panel 324. At any time, the total illuminated area of the panel is significantly smaller than the total panel area. This allows for the introduction of a delay between the illumination of a given pixel and the application of electric drive to the pixel, as will be further described below in FIG. 4, thereby maximizing brightness. Further, it allows for the use of more than three laser packages and eases optical alignment.

In display panel 324, pixels are controlled depending on the laser color being directed at them by the application of appropriate modulation voltages to them. For example, at a determined timing prior to directing a red laser at a given pixel of display panel 324, a modulation voltage corresponding to a red component associated with the pixel is applied to the pixel. As a result, display panel 324 affects the brightness of laser components 316, 318, and 320 directed at a given pixel based on the red, green, and blue components associated with the pixel, thereby modulating laser components 316, 318, and 320.

Projection lens 326 receives modulated beams corresponding to laser components 316, 318, and 320 and projects a corresponding image.

Example system 300 achieves high brightness levels. In one aspect, example system 300 benefits from the continuous mode of operation of laser sources 302, 304, and 306, which results in higher average output power. At the same time, example system 300 benefits from color scrolling in terms of spectrum efficiency and brightness without significant effect due to loss in system étendue. Indeed, since laser light is highly coherent and directional, its source étendue is very small. For example, laser sources can have étendues that are approximately three orders of magnitude lower than that of a lamp or an LED. As such, the reduction of system étendue due to scrolling has minimal effect on optical efficiency.

Example system 300 also benefits from color scrolling through a reduction of speckle patterns, which are commonly observed in laser optics. The speckle patterns originate from the narrow spectral width of the lasers. Any spatial inhomogeneity can cause interference of laser light at the projected screen. By focusing laser light into a narrow stripe, the spatial pattern is integrated in one dimension, reducing any relative variation. It is noted here that light does not necessarily have to be focused into a single stripe. For example, two or more stripes from one or more laser sources can be created. This is also the case in high power laser sources which typically employ multiple lasers in one package.

The overall brightness of example system 300 can be further increased by employing more than one display panel. For example, example system 300 may be implemented as a 2-panel system.

Example system 300 can be implemented using liquid crystal (LC) displays and/or digital mirror displays.

Figure 4:
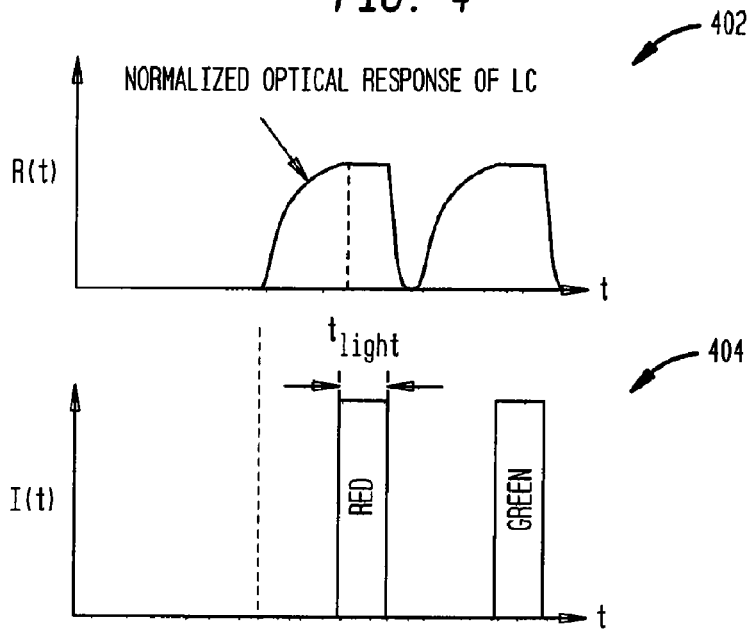
FIG. 4 illustrates example optical response and illumination functions of a liquid crystal pixel.

FIG. 4 illustrates example optical response and illumination functions of a liquid crystal pixel when a liquid crystal display panel is used in example system 300.

Example normalized optical response function 402 illustrates the response time of a liquid crystal pixel after the application of modulation voltages. Typically, even for fast switching liquid crystals, a pixel takes approximately 0.5 milliseconds before it reaches steady state response. This indicates that the optimal reflectivity of the liquid crystal is not reached immediately with the application of the modulation voltage and that loss may be incurred in terms of brightness if the illumination is applied before the pixel reaches steady state.

Example illumination function 404 illustrates an illumination scheme that optimizes brightness based on example normalized optical response function 402. Illumination function 404 ensures that laser pulses directed at the pixel coincide with full reflectivity periods of the pixel by delaying the illumination of the pixel with respect to application of the electric drive to the pixel, thereby maximizing brightness.

For liquid crystal displays, focusing the laser lights into very narrow stripes is also advantageous because it allows each row of pixels of the display panel to experience a short (in time) but very intense exposure of light. Note that these narrow stripes do not reduce the optical efficiency of the system owing to the small source étendue of the laser. In addition, a high degree of tolerance can be afforded with respect to the uniformity of the focused laser beams, as long as they are uniform after scrolling through the display. A human eye will integrate the light from a given pixel as the stripes scan through the pixel. Furthermore, owing to the small étendue of lasers, multiple lasers for each color can be used, focusing each laser into a narrow stripe. For example, if two red color lasers are used, they can be focused in such a way as to create two adjacent stripes on the display panel.

Figure 5:
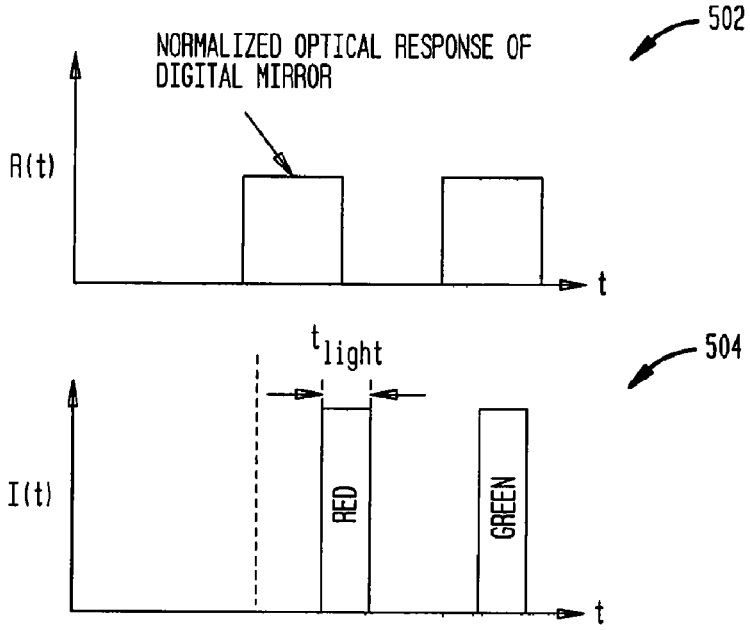
FIG. 5 illustrates example optical response and illumination functions of a digital mirror pixel.

Stripe illumination also has advantages for digital mirror displays. FIG. 5 illustrates example optical response and illumination functions of a digital mirror pixel when a digital mirror display panel is used in example system 300.

Example normalized optical response function 502 illustrates the response time of a digital mirror pixel after the application of modulation voltages. As illustrated, a digital mirror pixel can be switched ON to full reflectivity or OFF to zero reflectivity almost instantaneously. Accordingly, no loss in brightness due to slowness of the optical response can be incurred.

Example illumination function 504 illustrates an illumination scheme, which together with normalized optical response function 502 can be used to control the brightness of the pixel. Note that the time overlap between illumination pulses in function 504 and the periods of full reflectivity in function 502 determine the brightness of the pixel. Optimal brightness is achieved when full overlap occurs between an illumination pulse and a period of full reflectivity.

Accordingly, normalized optical response function 502, illumination function 504, or both can be controlled to control the brightness of the pixel. Normalized optical response function 502 can be controlled by controlling the timing of modulation voltages applied to the pixel. Illumination function 504 can be controlled by controlling the laser scrolling scheme. In an embodiment, optical response function 502 is controlled by using a batch update mode to update the color information associated with the pixel before corresponding color illumination stripes are applied onto the pixel.

The example illumination scheme of FIG. 5 may also be used in cases where it is desirable to increase the color bit depth of the pixels without reducing the bit plane time for the least significant bit of the pixel value. Typically, due to limited data bandwidth between the controller electronics and the digital mirror display, an increase in color bit depth is compensated by a reduction in the time for the least significant bit of the pixel value. Another option is to reduce the intensity of the laser by reducing the drive voltage. Alternatively, another option is by using the example illumination scheme of FIG. 5 to reduce the overlap time between pixel modulation and scanning laser light stripe.

Figure 6:
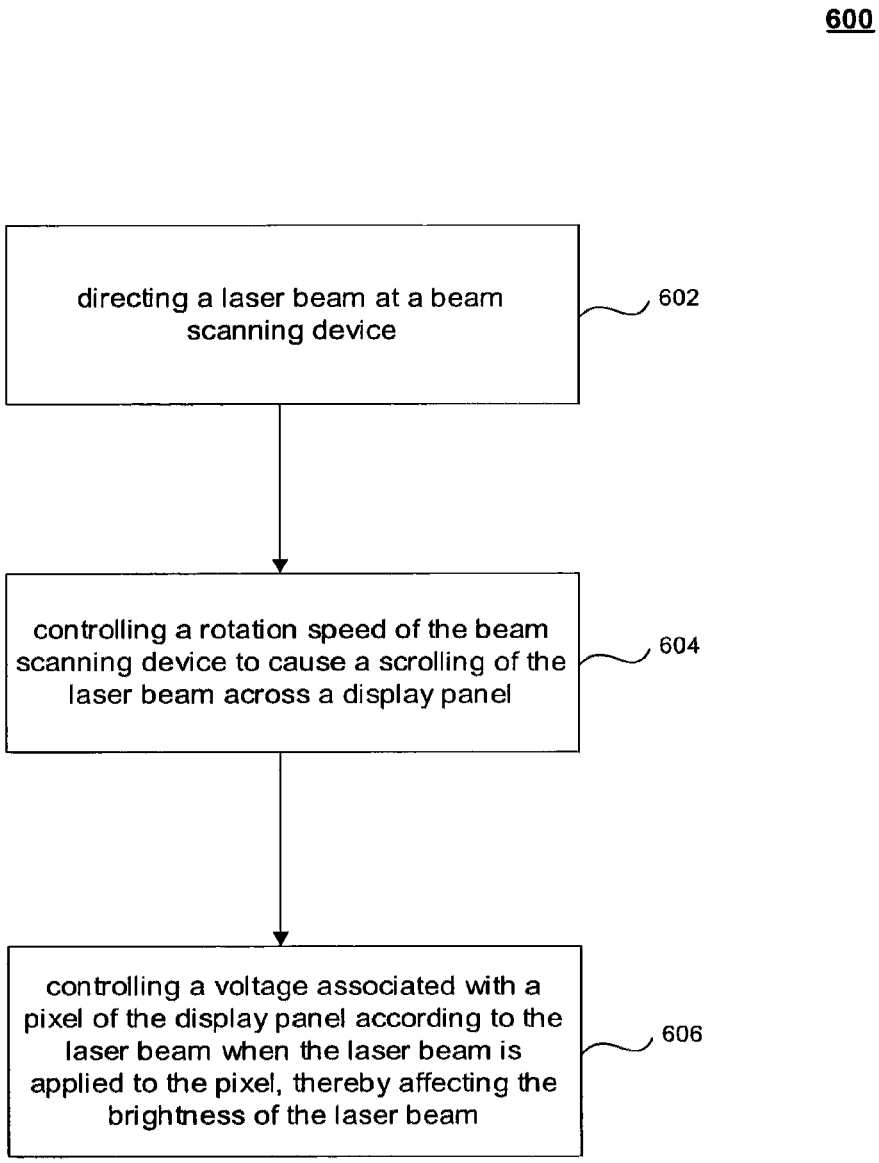
FIG. 6 is a process flowchart of a method for displaying a color image on a display.

FIG. 6 is a process flowchart 600 of a method for displaying a color image on a display.

Process flowchart 600 begins in step 602, which includes directing a laser beam at a beam scanning device. In an embodiment, the laser beam is a plurality of laser beams. In an embodiment, step 602 includes directing red, blue, and green laser beams at the beam scanning device. In another embodiment, step 602 includes continuously directing the laser beams at the beam scanning device.

Step 604 includes controlling a rotation speed of the beam scanning device to cause a scrolling of the laser beam across a display panel. In an embodiment, the laser beam is beam shaped, prior to directing it at the beam scanning device, so as to cause at least two color patterns to appear on the display panel without overlap. In an embodiment, step 604 further includes controlling the rotation speed of the beam scanning device according to an update rate of the display panel. In another embodiment, step 604 includes controlling the rotation speed of the beam scanning according to an optical response function associated with pixels of the display panel. In a further embodiment, step 604 includes controlling the rotation speed of the beam scanning according to an illumination function enabled by the laser beam.

Step 606 includes controlling a voltage associated with a pixel of the display panel according to the laser beam when the laser beam is applied to the pixel, thereby affecting the brightness of the laser beam. In an embodiment, step 606 includes controlling the application time of the voltage to the pixel according to the application time of the laser beam to the pixel. In an embodiment, the voltage is applied to the pixel prior to the laser beam is applied to the pixel, thereby allowing the pixel to reach full reflectivity. In another embodiment, step 606 includes controlling the value of the voltage according to color information associated with the pixel.

Conclusion

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method for displaying a color image on a display, comprising:

reflecting a plurality of individual laser beams to produce a combined laser beam;

receiving said combined laser beam, regenerating the plurality of individual laser beams from said combined laser beam, and shaping each individual laser beam of the plurality of individual laser beams as a stripe having an aspect ratio larger than the aspect ratio of a display panel;

directing a first one of said plurality of shaped individual laser beams at a beam scanning device at a first angle of incidence;

directing a second one of said plurality of shaped individual laser beams at said beam scanning device at a second angle of incidence, and said first angle of incidence is different from said second angle of incidence;

controlling a rotation speed of said beam scanning device to cause a scrolling of said shaped individual laser beams across the display panel; and controlling a voltage associated with a pixel of said display panel according to provided color information when one of said shaped individual laser beams is applied to said pixel, thereby affecting the brightness of said one of said shaped individual laser beams.

2. The method of claim 1, wherein said first individual laser beam is a red laser beam, said second individual laser beam is a green laser beam and comprising directing a third individual laser beam of the plurality of shaped individual laser beams at said beam scanning device at a third angle of incidence, wherein said third individual laser beam is a blue laser beam and said third angle of incidence is different from said first and second angles of incidence.

3. The method of claim 1, wherein said directing step comprises continuously directing said plurality of shaped individual laser beams at said beam scanning device.

4. The method of claim 1, wherein said directing step comprises directing in a substantially continuous mode said plurality of shaped individual laser beams at said beam scanning device.

5. The method of claim 1, wherein said directing step comprises directing said plurality of shaped individual laser beams at a spinning polygon mirror.

6. The method of claim 1, wherein said directing step comprises directing said plurality of shaped individual laser beams at a rotating prism.

7. The method of claim 1, wherein said step of controlling the rotation speed of said beam scanning device comprises controlling the rotation speed of said beam scanning device according to an update rate of said display panel.

8. The method of claim 1, wherein said step of controlling the rotation speed of said beam scanning device comprises controlling the rotation speed of said beam scanning according to an optical response function associated with said pixel.

9. The method of claim 1, wherein said step of controlling the rotation speed of said beam scanning device comprises controlling the rotation speed of said beam scanning device according to an illumination function enabled by one of said plurality of shaped individual laser beams.

10. The method of claim 1, wherein said step of controlling said voltage comprises controlling an application time of said voltage to said pixel according to an application time of one of said plurality of shaped individual laser beams to said pixel.

11. The method of claim 1, wherein said voltage is applied to said pixel prior to a time when one of said plurality of shaped individual laser beams is applied to said pixel, thereby allowing the optical response of said pixel to reach full reflectivity.

12. The method of claim 1, wherein said step of controlling said voltage comprises controlling values of said voltage according to color information associated with said pixel.

13. The method of claim 1, wherein at least two individual laser beams of the plurality of shaped individual laser beams are directed at the display panel at any given time.

14. A projection display system, comprising:

a plurality of laser sources configured to emit a plurality of individual laser beams;

at least one laser mirror configured to reflect said individual laser beams to produce a combined laser beam;

a beam scanning device; and a light control apparatus configured to receive said combined laser beam, regenerate a plurality of individual laser beams from said combined laser beam and shape each individual laser beam as a stripe having aspect ratio larger than an aspect ratio of a display panel, such that each individual laser beam of the plurality of shaped individual laser beams is directed at said beam scanning device at a different angle of incidence;

wherein said beam scanning device is configured to reflect and direct said plurality of shaped individual laser beams at a display panel; and wherein said beam scanning device is configured to rotate at a speed to cause a scrolling of said plurality of shaped individual laser beams across a surface of said display panel, and wherein said display panel is configured to modulate said plurality of shaped individual laser beams according to provided color information for each individual laser beam to produce a plurality of modulated laser beams.

15. The system of claim 14, wherein said plurality of laser sources is configured to emit at least red, blue, and green laser beams.

16. The system of claim 14, wherein said beam scanning device comprises a scanning mirror.

17. The system of claim 14, wherein said beam scanning device comprises a polygon mirror.

18. The system of claim 14, wherein said beam scanning device comprises a rotating prism.

19. The system of claim 14, wherein the display panel is a liquid crystal display panel.

20. The system of claim 14, wherein the display panel is a digital mirror display panel.

21. The system of claim 14, wherein said speed of said beam scanning device is controlled according to an update rate of said display panel.

22. The system of claim 14, wherein the display panel includes a plurality of display panels.

23. The system of claim 14, further comprising:

a projection lens configured to receive said plurality of modulated laser beams to generate a corresponding color image.

24. The system of claim 14, wherein said beam scanning device is configured to reflect and direct at least two individual laser beams of the plurality of shaped individual laser beams at the display panel at any given time.

25. A method for displaying a color image on a display, comprising:

reflecting a plurality of individual laser beams to produce a combined laser beam;

receiving said combined laser beam, regenerating a plurality of individual laser beams from said combined laser beams, and shaping each individual laser beam of the plurality of individual laser beams as a stripe having an aspect ratio larger than the aspect ratio of a display panel;

directing the plurality of shaped individual laser beams at a beam scanning device at an angle of incidence for each individual laser beam of the plurality of shaped individual laser beams, wherein each individual laser beam of the plurality of shaped individual laser beams is directed at said beam scanning device at a different angle of incidence;

controlling a rotation speed of said beam scanning device to cause a scrolling of said plurality of shaped individual laser beams across a surface of the display panel; and controlling a voltage applied to a pixel of said display panel according to provided color information of one of said shaped individual laser beams directed at said pixel, thereby affecting the brightness of said one of said individual laser beams.

* * * * *